US005234136A

United States Patent [19]

Kopis

[11] Patent Number: 5,234,136

[45] Date of Patent: Aug. 10, 1993

[54] PROPEL-REPEL PACKAGE TUBES WITH PUSH ACTION

[75] Inventor: Floyd B. Kopis, Lombard, Ill.

[73] Assignee: Kopis Machine Co., Inc., Addison, Ill.

[21] Appl. No.: 829,743

[22] Filed: Jan. 31, 1992

[51] Int. Cl.[5] ..... B67D 5/42

[52] U.S. Cl. ..... 222/391; 401/66; 401/182

[58] Field of Search ..... 222/391; 401/179, 176, 401/180, 182, 181, 66

[56] References Cited

U.S. PATENT DOCUMENTS

| | | | |
|---|---|---|---|
| 261,456 | 7/1882 | Hoffman | 401/66 |
| 1,244,324 | 10/1917 | Hackley | 222/391 X |
| 3,108,687 | 10/1963 | Dayton . | |
| 3,132,743 | 5/1964 | Wolff . | |
| 3,215,320 | 11/1965 | Heisler et al. | 222/391 |
| 3,338,397 | 8/1967 | Noyack et al. . | |
| 3,378,176 | 4/1968 | Synder | 222/391 X |
| 3,728,034 | 4/1973 | Winter . | |
| 3,989,392 | 11/1976 | Seidler . | |
| 4,696,594 | 9/1987 | Powers . | |
| 4,778,300 | 10/1988 | French et al. . | |
| 4,892,427 | 1/1990 | Ford | 222/391 X |

FOREIGN PATENT DOCUMENTS

| | | | |
|---|---|---|---|
| 407604 | 11/1944 | Italy | 222/391 |

OTHER PUBLICATIONS

Drawing having the identifying legends at the top thereof: Zeller Packaging Network and Zeltube.

*Primary Examiner*—Gregory L. Huson
*Attorney, Agent, or Firm*—Palmatier & Zummer

[57] ABSTRACT

A lip balm or other stick is adapted to be propelled and repelled by a piston slidable in a first end opening of a package tube having a second end opening in which a knob is slidable and rotatable approximately 90 degrees between propel and repel positions. An axial post on the knob is adapted to be connected to the piston by a reversible translatory clutch comprising propel and repel pawls on the piston, spaced apart approximately 90 degrees, and engageable by ratchet teeth and interspersed ratchet notches adapted to be presented to the propel pawls, when the knob is in its propel position, and to the repel pawls, when the knob is turned approximately 90 degrees to its repel position. A spring biases the knob outwardly and is operative to repel the piston after the knob is pushed inwardly when in its repel position. When in its propel position, the ratchet teeth propel the propel pawls when the knob is pushed inwardly. In a second embodiment, the post has friction clutch surfaces of enlarged diameter and adapted to be presented selectively to the propel and repel pawls by turning movement of the knob.

18 Claims, 4 Drawing Sheets

PROPEL-REPEL PACKAGE TUBES WITH PUSH ACTION

FIELD OF THE INVENTION

This invention relates to package tubes for holding and dispensing sticks of lip balm or a similar material, such as lipstick or other cosmetic preparations, for example.

BACKGROUND OF THE INVENTION

Various package tubes are known for holding and dispensing lip balm and other similar materials. One commonplace construction utilizes a tubular housing having a first or upper end formed with a cylindrical opening, adapted to receive a stick of lip balm or the like, and a second or lower end in which a knob is rotatable. The knob operates a screw mechanism for propelling the stick of lip balm or the like out of the housing, as needed. In some cases, the stick can be repelled or retracted by turning the knob in the opposite direction.

Another package tube construction is known utilizing a tubular housing having a cylindrical opening in its first or upper end, for receiving a pasty material. The tubular housing has a second or lower end in which a push button knob is movable upwardly through a short distance by the user and is adapted to be returned downwardly by a spring in the housing. A post extends upwardly from the push button knob and is provided with annular ratchet teeth for engaging a ratchet pawl on a piston which is slidable in the cylindrical opening. The pasty material is contained in the cylindrical opening between the piston and the first or upper end of the tubular housing. When the push button knob is pushed upwardly by the user, the pasty material is dispensed out of the first or upper end of the housing. When the push button knob is released, it is returned downwardly by the spring. The post is returned downwardly with the push button knob, but the position of the piston is not disturbed, because the ratchet teeth on the post slide downwardly past the ratchet pawl on the piston. There is no provision for repelling or retracting the piston.

OBJECTS OF THE INVENTION

One object of the present invention is to provide a new and improved package tube having a push action mechanism which is selectively adjustable for either propelling or repelling a piston in the package tube, whereby a stick of lip balm or the like, received in the package tube between the piston and the open end of the tube, may be either propelled out of the tube or repelled or retracted into the tube.

A further object of the present invention is to provide a new and improved package tube of the foregoing character, which can be switched between its propel mode and its repel mode by turning its actuating knob through a predetermined angle between propel and repel positions.

A still further object of the present invention is to provide a new and improved package tube of the foregoing character in which the same actuating knob is operable as a push button by the user, for either propelling or repelling the piston and the stick of lip balm and the like.

Another object of the present invention is to provide a new and improved selectively reversible one-way translatory clutch.

SUMMARY OF THE INVENTION

To attain these and other objects, the present invention may provide a package tube for receiving and dispensing a stick of lip balm or the like, the package tube comprising a tubular housing having first and second opposite ends, the first end having a first generally cylindrical opening therein for receiving the stick of lip balm or the like and for dispensing the stick out of the first end of the housing, a generally cylindrical piston slidably movable in the cylindrical opening and engageable with the stick for pushing the stick out of the opening, the second end of the tubular housing having a second generally cylindrical opening therein, a generally cylindrical operating knob rotatably and slidably received in the second cylindrical opening at the second end of the tubular housing, the knob having an axial post thereon extending axially into the tubular housing along portions of the second cylindrical opening and the first cylindrical opening, the housing and the knob having first stop means for retaining the knob in the housing for limited axial sliding movement into and out of the second opening in the housing, the housing and the knob having second stop means for limiting the rotation of the knob to a turning movement of a predetermined angle, such as approximately 90 degrees, between propel and repel positions, the piston having at least one propel pawl and at least one repel pawl thereon spaced apart by the predetermined angle, the post having at least one ratchet means thereon for selective presentation to the propel pawl when the knob is in its propel position and to the repel pawl when the knob is in its repel position, and spring means acting between the tubular housing and the knob for resiliently biasing the knob outwardly relative to the second opening in the housing, the knob when in its propel position being movable inwardly for propelling the piston and the stick and thereby dispensing the stick, the knob when in its repel position being movable inwardly against the biasing action of the spring means and being movable outwardly by the spring means for repelling the piston and the stick.

The piston preferably has a pair of diametrically opposite propel pawls and a pair of diametrically opposite repel pawls thereon, the propel pawls and the repel pawls being spaced apart by a predetermined angle, such as approximately 90 degrees, the post having a pair of diametrically opposite ratchet means thereon for selective presentation to the propel pawls when the knob is in its propel position and to the repel pawls when the knob is in its repel position.

Preferably, each of the propel pawls slants radially inwardly and toward the second end of the tubular housing, while each of the repel pawls slants radially inwardly and toward the first end of the tubular housing.

The ratchet means preferably comprise diametrically opposite sets of ratchet teeth on the post and alternating with ratchet notches therein, the post having a pair of substantially smooth portions disposed between the diametrically opposite sets of ratchet teeth.

The piston and the pawls are preferably formed in one piece from a resilient resinous plastic material, each of the pawls being blade-like in shape and having a portion of reduced thickness forming a flexible resilient hinge-like structure.

The package tube preferably includes longitudinal rib and groove means disposed between the tubular housing and the piston for preventing rotation of the piston in the first cylindrical opening while providing for sliding movement of the piston along the first cylindrical opening.

The package tube preferably includes sealing means between the piston and the post for preventing any substantial leakage of lip balm or other material therebetween, the sealing means comprising a bushing mounted in the piston and having an axial opening for slidably receiving the post.

The first stop means preferably comprise a transverse wall in the housing and having an axial opening for receiving the post, and a tapered flange projecting outwardly from the post for easy press fitting through the axial opening in the transverse wall.

The spring means preferably comprise a coil spring received around the post and compressed between the transverse wall and the knob.

In another aspect, the present invention may provide a package tube for receiving and dispensing a stick of lip balm or the like, the package tube comprising a tubular housing having first and second opposite ends, the first end having a first generally cylindrical opening therein for receiving the stick of lip balm or the like and for dispensing the stick out of the first end of the housing, a generally cylindrical piston slidably movable in the cylindrical opening and engageable with the stick for pushing the stick out of the opening, the second end of the tubular housing having a second generally cylindrical opening therein, a generally cylindrical operating knob rotatably and translatably received in the second cylindrical opening at the second end of the tubular housing, the knob having an axial post thereon extending axially into the tubular housing along portions of the second cylindrical opening and the first cylindrical opening, the housing and the knob having first stop means for retaining the knob in the housing for limited axial translatory movement into and out of the second opening in the housing, the housing and the knob having second stop means for limiting the rotation of the knob to a turning movement through a predetermined angle between propel and repel positions, the piston and the post having selectively operable one-way propelling clutch means operative when the knob is turned to its propel position for translating the piston toward the first end of the housing, the piston and the post having selectively operable one-way repelling clutch means operative when the knob is turned to its repel position for repelling the piston toward the second end of the housing, the propelling clutch means comprising a pair of diametrically opposite propel pawls on the piston, the repelling clutch means comprising a pair of diametrically opposite repel pawls on the piston, the propel pawls and the repel pawls being spaced apart on the piston by the predetermined angle, the post having diametrically opposite clutch members thereon for selective presentation to the propel pawls when the knob is in its propel position and to the repel pawls when the knob is in its repel position, and spring means acting between the tubular housing and the knob for resiliently biasing the knob outwardly relative to the second opening in the housing, the knob when in its propel position being movable inwardly for propelling the piston and the stick and thereby dispensing the stick, the knob when in its repel position being movable inwardly against the biasing action of the spring means and being movable outwardly by the spring means for repelling the piston and the stick.

In one embodiment, the propel and repel pawls are in the form of ratchet pawls, the clutch members on the post comprising diametrically opposite sets of ratchet teeth on the post and alternating with ratchet notches therein for selective angular adjusting movement between the propel pawls and the repel pawls when the knob is turned between the respective propel and repel positions thereof.

In accordance with another embodiment, the propel clutch pawls are in the form of a pair of diametrically opposite friction clutch pawls on the piston and slanting radially inwardly and toward the second end of the tubular housing, the repel clutch pawls being in the form of a pair of diametrically opposite friction clutch pawls on the piston and slanting radially inwardly and toward the first end of the tubular housing, the clutch members on the post being in the form of a pair of diametrically opposite friction clutch members projecting radially outwardly on the post to an enlarged diameter relative to the remainder of the post for angular movement between operative engagement with the propel pawls and the repel pawls when the knob is turned between its respective propel and repel positions.

The propel and repel pawls are preferably in the form of flexible resilient blade-like members having end edges for frictional engagement with the frictional clutch members on the post, the frictional clutch members having diametrically opposite smooth frictional surfaces of relatively great diameter, the post having portions of relatively smaller diameter interspersed between the clutch surfaces and adapted to be spaced radially inwardly out of engagement with the pawls.

The flexible resilient blade-like members are preferably made of sheet metal.

Preferably, all of the flexible resilient blade-like members are formed from a single piece of sheet metal mounted on the piston.

In another embodiment, the invention provides a selectively reversible one-way translatory clutch, comprising an elongated post, means supporting the post for axial translatory movement in opposite propel and repel directions, the means also providing for angular rotary adjusting movement of the post through a limited predetermined angle about its axis between propel and repel positions, a translatory member having means for supporting the member for axial translatory movement in the propel and repel directions along the axis of the post, a pair of diametrically opposite propel pawls on the member, and a pair of diametrically opposite repel pawls on the member, the propel and repel pawls being spaced apart by the predetermined angle about the axis of the post, the propel pawls comprising a pair of diametrically opposite flexible resilient blade-like propel pawl members having end edges for frictional engagement with the post, the blade-like propel pawl members slanting radially inwardly and in the repel direction, the repel pawls comprising a pair of diametrically opposite flexible resilient blade-like repel pawl members having end edges for frictional engagement with the post, the repel pawl members slanting radially inwardly and in the propel direction, the post having diametrically opposite frictional clutch surfaces of relatively great diameter, the post having portions of relatively small diameter interspersed between the frictional clutch surfaces and adapted to be spaced radially inwardly out of operative engagement with the pawls, the frictional clutch surfaces being selectively movable into engagement with the propel clutch members when the post is rotated to its propel position while being selectively movable into frictional engagement with the repel pawl members when the post is rotated to its repel position.

In the selectively reversible one-way translatory clutch, the blade-like propel clutch pawl members and the blade-like repel clutch pawl members are preferably made of flexible resilient sheet metal.

The blade-like propel clutch members and the blade-like repel clutch members are preferably formed on a single piece of flexible resilient sheet metal, the clutch preferably including means for preventing rotation of the single piece of sheet metal about the axis of the post.

BRIEF DESCRIPTION OF THE DRAWINGS

Further objects, advantages and features of the present invention will appear from the following description, taken with the accompanying drawings, in which.

DETAILED DESCRIPTION OF ILLUSTRATIVE EMBODIMENTS

Figure 1:
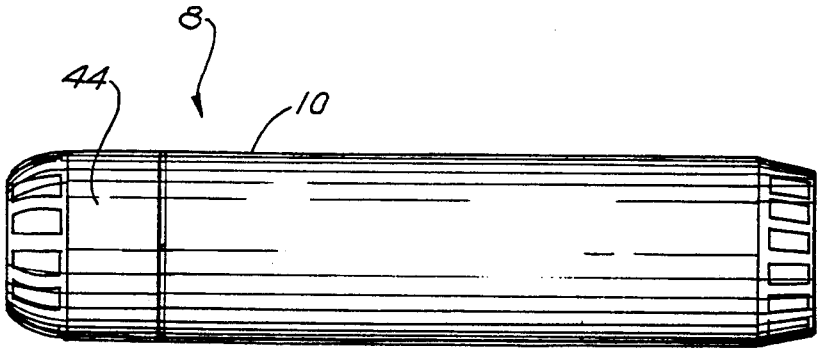
FIG. 1 is an elevational view of a package tube to be described as an illustrative embodiment of the present invention.

As indicated above, FIGS. 1-18 illustrate a first embodiment of the invention in the form of a propel-repel package tube 8 including a tubular housing 10 in which a generally cylindrical piston 12 is slidable upwardly and downwardly to propel and repel a stick 13 of lip balm or some other substance to be dispensed. A generally cylindrical knob 14 is provided opposite the lower end of the tubular housing 10 and is adapted to be pushed upwardly to elevate the piston 12, when the package tube 8 is in its propel mode. A spring 16 is provided to retract the knob 14 downwardly when it is released. The spring 16 is positioned between the knob 14 and a transverse or lower wall 18 of the tubular housing 10.

Figure 2:
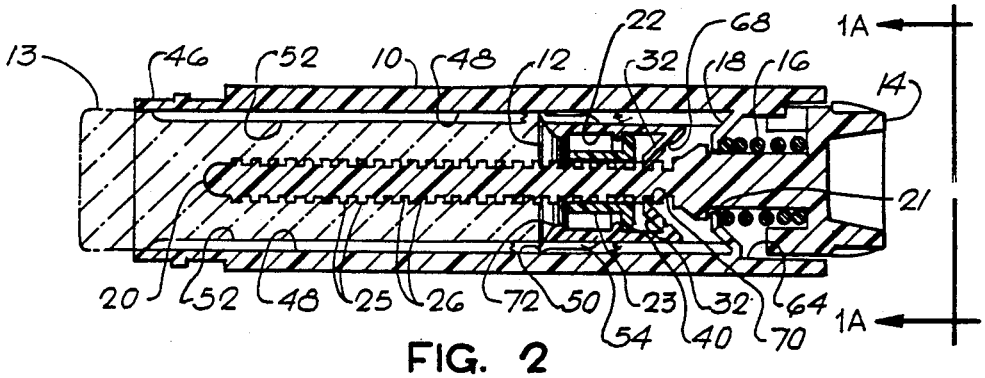
FIG. 2 is a longitudinal section taken through the package tube, generally as indicated by the line 2—2 in FIG. 1A, the package tube being shown in its repel mode.

For convenience and brevity, the propel and repel directions are sometimes referred to herein as upward and downward, respectively, with the understanding that the package tube 8 is not position-sensitive but may be used in any position. In FIGS. 1 and 2, the upper or first end of the package tube 8 is directed toward the left, while the lower or second end is directed toward the right.

An axial post 20 extends upwardly from the knob 14 through an opening 21 in the transverse wall 18, and also through an opening 22 in a bushing 23 mounted in an axial opening 24 formed in the piston 12. The post 20 is generally cylindrical, but it has two sets of ratchet teeth 25 alternating with ratchet notches 26 on diametrically opposite sides of the post 20. Between the two sets of ratchet teeth 25, the post 20 has a pair of diametrically opposite sides 28 which are smooth and cylindrically curved.

The interior of the piston 12 is formed with a pair of resilient diametrically opposite up or propel pawls 30 which slant radially inwardly and downwardly for engagement with the post 20. In addition, the piston 12 is formed with a pair of resilient diametrically opposite down or repel pawls 32 which slant radially inwardly and upwardly for engagement with the post 20. The propel pawls 30 and the down pawls 32 are spaced apart by a predetermined angle, illustrated as substantially ninety degrees, around the axis of the piston 12.

The package tube 8 is switched between its propel mode and its repel mode by rotating or turning the knob 14 through a predetermined angle, such as substantially ninety degrees. The turning movement of the knob 14 is limited by stop means comprising first stops or tabs 34 projecting upwardly therefrom, and engageable with second stops 36 formed on the tubular housing 10.

In FIG. 2, the package tube 8 is shown in its repel mode, in which the repel pawls 32 are adapted to engage the ratchet teeth 25 and notches 26 in the post 20, while the propel pawls 30 are opposite the smooth surfaces 28 of the post 20. When the knob 14 is pushed upwardly or toward the first end of the tubular housing 10, the repel pawls 32 allow the post 20 to slide upwardly through the bushing 23 in the piston 12 and to ratchet idly past the repel pawls 32, the ends of which come to rest in a pair of the ratchet notches 26. When the knob 14 is released, the spring 16 pushes the knob 14 and the post 20 downwardly or toward the second end of the housing 10. The engagement between the ratchet notches 26 and the down pawls 32 causes the piston 12 to move downwardly with the post 20, so as to repel or retract the stick 13 of lip balm or other material to be dispensed. The downward movement of the post 20 is limited by the engagement of a flange 38 with the upper side of the transverse wall 18. The flange 38 has a tapered upper side 39 to facilitate the movement or press fitting of the flange 38 upwardly through the opening 21 in the transverse wall 18, during the assembly of the package tube 8.

Figure 2A:
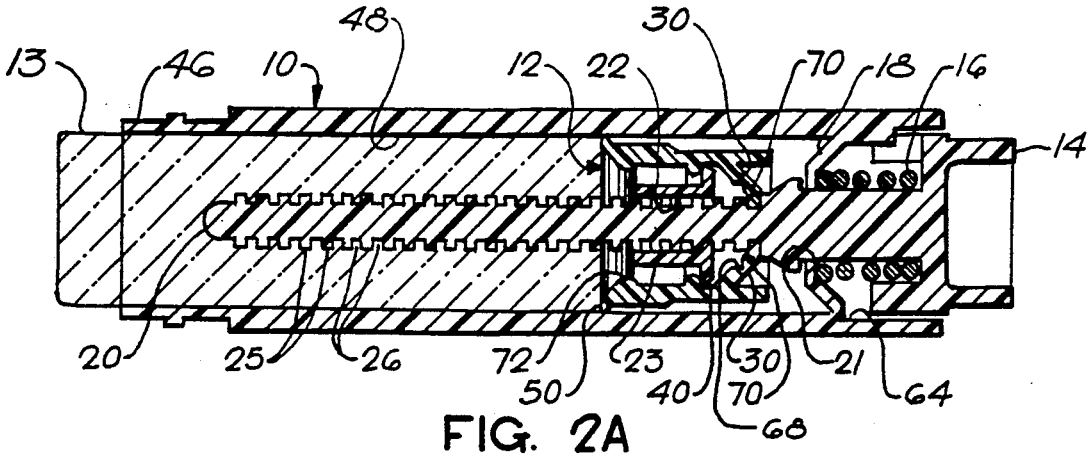
FIG. 2A is a longitudinal section, similar to FIG. 2, but taken along the line 2A—2A in FIG. 1A, and showing the package tube in its propel mode.

The knob 14 may be rotated through substantially ninety degrees to switch the package tube 8 to its propel mode, in which the downwardly slanting propel pawls 30 engage the ratchet teeth 25 and notches 26, while the upwardly slanting repel pawls 32 are opposite the smooth surfaces 28 of the post 20, as shown in FIG. 2A. When the knob 14 is pushed upwardly, the ratchet teeth 25 and notches 26 engage the propel pawls 30 and cause the piston 12 to travel upwardly with the post 20, toward the first end of the housing 10. When the knob 14 is released, the spring 16 returns the knob 14 and the post 20 downwardly, whereupon the propel pawls 30 allow the post 20 to ratchet idly downwardly past the propel pawls 30.

Figure 5:
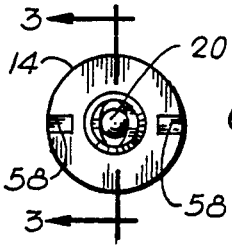
FIG. 5 is an opposite end view, showing the knob and the post.
Figure 7:
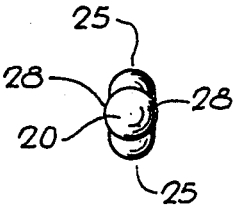
FIG. 7 is a fragmentary end view of the post.
Figure 6:
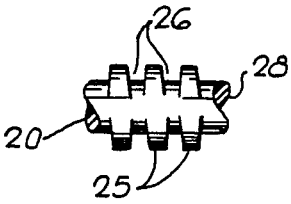
FIG. 6 is a fragmentary enlarged elevation of the post.
Figure 1A:
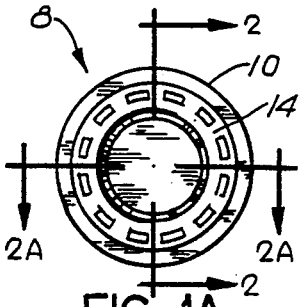
FIG. 1A is an end view of the package tube, taken generally as indicated by the line 1A-1A in FIG. 2.
Figure 16:
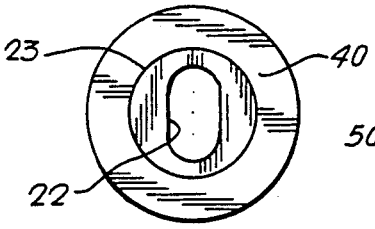
FIG. 16 is an enlarged end view of the sealing bushing for the piston.
Figure 17:
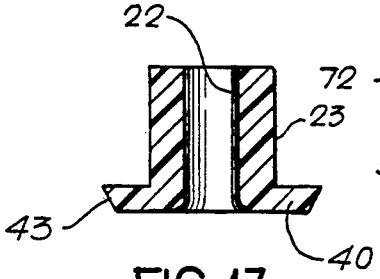
FIG. 17 is a longitudinal section taken through the bushing.
Figure 18:
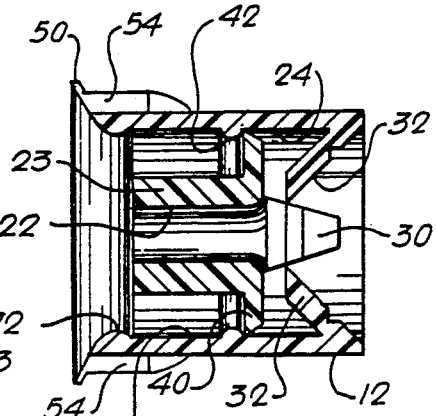
FIG. 18 is a longitudinal section through the piston, similar to FIG. 12 but also showing the sealing bushing assembled with the piston.

The lip balm or other material in the stick 13 is generally of a highly viscous pasty character. The bushing 23 acts as a sealing means to prevent any substantial leakage of the lip balm or other material between the bushing 23 and the post 20. The opening 22 in the bushing 23 is oval in shape, as shown in FIG. 16, to correspond with the cross-sectional shape of the post 20, taken through the ratchet teeth 25, as shown in FIGS. 5 and 7. The bushing 23 is formed with an outwardly projecting annular flange 40 adapted to fit within the cylindrical opening 24 in the piston 12, to afford a sealing action therewith. As shown in FIGS. 2 and 18, the flange 40 seats against the propel pawls 30 and is retained by an internal annular bead or ridge 42, projecting inwardly on the piston 12 from the interior surface of the opening 24. The bushing 23 is installed by pushing it to the right, as shown in FIG. 18, until the flange 40 snaps past the annular bead 42. To facilitate such installation, the flange 40 is formed with a tapered annular surface 43 around its periphery.

Both the piston 12 and the bushing 23 are preferably molded or otherwise formed from a suitable flexible resilient resinous plastic material, such as polyethylene or polypropylene. The same is true of the tubular housing 10 and the knob 14. As shown, the post 20 is molded in one piece with the knob 14.

As shown in FIG. 1, the package tube 8 also comprises a cup shaped closure cap 44, adapted to fit snugly around a reduced upper portion 46 of the tubular housing 10 to cover and protect the exposed upper end of the stick 13 of lip balm or the like. The cap 44 may also be made of a suitable resinous plastic material, such as polyethylene or polypropylene.

As shown in FIGS. 2, 8 and 11–15, the tubular housing 10 is formed with a first generally cylindrical interior surface or opening 48 along which the piston 12 is slidable. To afford sealing means, the piston 12 is formed with an outwardly projecting generally annular sealing lip 50 which is snugly slidable along the generally cylindrical interior surface 48. The sealing lip 50 prevents any substantial leakage of the lip balm or the like, between the piston 12 and the tubular housing 10.

Figure 10:
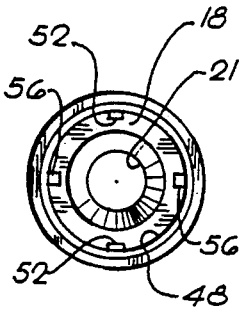
FIG. 10 is a left-hand end view of the tubular housing.
Figure 8:
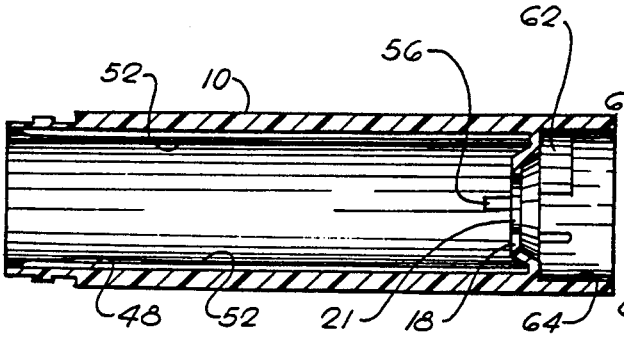
FIG. 8 is a longitudinal section of the tubular housing, taken generally along the line 8—8 in FIG. 9.

Means are provided to prevent rotation of the piston 12 within the tubular housing 10. As shown in FIGS. 8 and 10, the interior of the tubular housing 10 is formed with a pair of diametrically opposite longitudinal ribs 52, projecting inwardly from the cylindrical interior surface 48. The sealing lip 50 and adjacent portions of the piston 12 are formed with diametrically opposite slots or grooves 54 for slidably receiving the ribs 52 throughout the range of sliding movement of the piston 12. The ribs 52 and the grooves 54 maintain the piston 12 and the pawls 30 and 32 in the proper orientation with the knob 14 and the post 20. The locations of the ribs 52 and the grooves 54 could be reversed.

Stop means are preferably provided to limit the retracting movement of the piston 12 as it is moved downwardly toward the transverse wall 18 of the tubular housing 10. Such downward movement is directed to the right as shown in FIGS. 2 and 8. Such stop means are afforded by a pair of diametrically opposite stop tabs 56, projecting inwardly from the cylindrical interior surface 48, adjacent the transverse wall 18, as shown in FIGS. 8 and 10.

Figure 3:
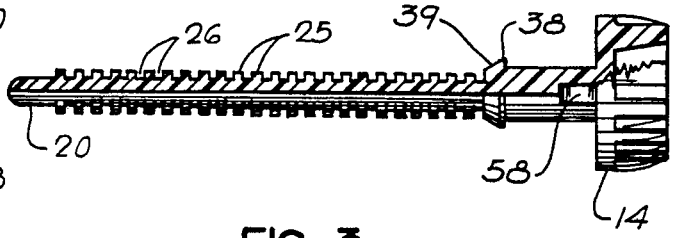
FIG. 3 is an elevational view of the operating knob and post, partly in longitudinal section along the line 3—3 in FIG. 5.
Figure 4:
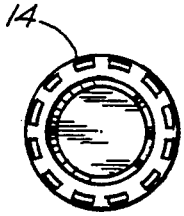
FIG. 4 is an end view of the operating knob.
Figure 9:
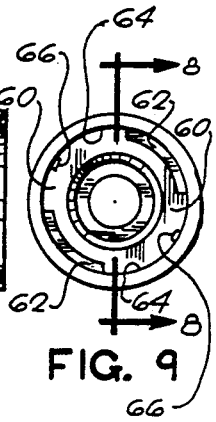
FIG. 9 is a right-hand end view of the tubular housing.
Figure 14:
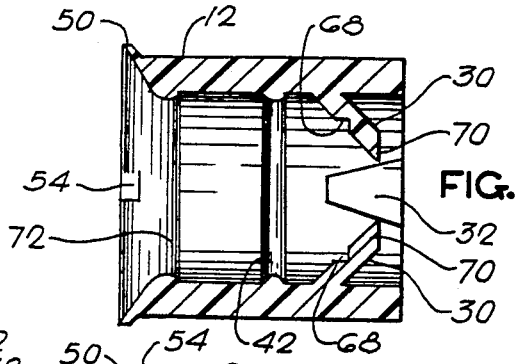
FIG. 14 is a longitudinal section taken through the piston, generally along the line 14—14 in FIG. 11.
Figure 11:
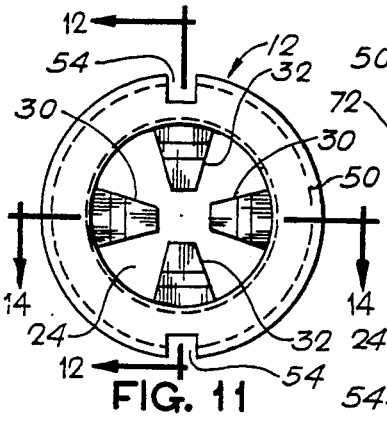
FIG. 11 is an enlarged left-hand end view of the piston with the pawls thereon.
Figure 12:
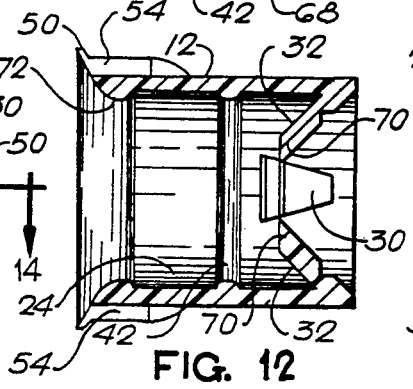
FIG. 12 is a longitudinal section through the piston, taken generally along the line 12—12 in FIG. 11.
Figure 13:
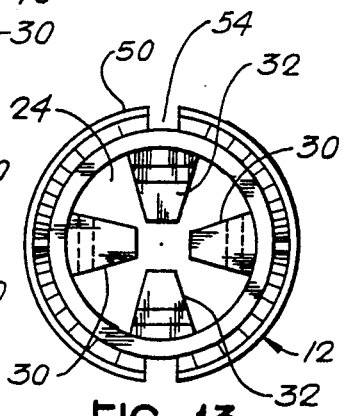
FIG. 13 is a right-hand end view of the piston.
Figure 15:
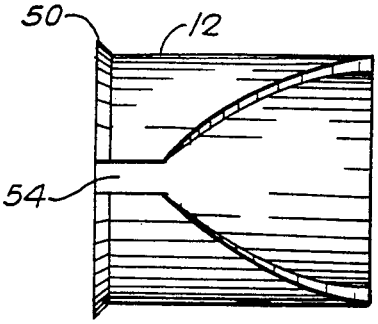
FIG. 15 is an elevational view of the piston.

Means are also provided for limiting the turning movement of the knob 14 through a predetermined angle, illustrated as approximately 90 degrees, around the rotary axis of the knob. As shown in FIGS. 3 and 5, the knob 14 is provided with a pair of diametrically opposite stop tabs 58, projecting upwardly from the knob. The stop tabs 58 are adapted to be received in a pair of arcuate spaces 60 formed between arcuate stop ribs 62, projecting inwardly from a second internal cylindrical surface 64 formed in the second or right hand end portion of the tubular housing 10, as shown in FIGS. 8 and 9. It will be seen that the internal cylindrical surface 64 is also formed with inwardly projecting detent ribs 66, engageable by the stop tabs 58 and adapted to detain the knob 14 in its position of clockwise adjustment.

As shown in FIGS. 11–14, the propel pawls 30 and the repel pawls 32 are molded in one piece with the piston 12 which is preferably made of a flexible resilient resinous plastic material, such as polyethylene. To increase the flexibility of the pawls 30 and 32, each of the pawls is formed with a transverse notch or groove 68 whereby the cross sectional thickness of the pawl is reduced to form a resilient hinge-like structure. Each of the pawls 30 and 32 is preferably blade-like and is provided with a tip portion in the form of a chisel point or edge 70, for entry into the ratchet notches 26 in the post 20.

As shown in FIGS. 2, 12, 14 and 18, the piston 12 is formed with an annular bead or rib 72 which projects radially inward within the piston 12, near the open end of the cylindrical opening 24. The rib 72 is adapted to interlock with the lip balm or other material in the stick 13 which is to be dispensed by the package tube 8. The interlocking relationship between the rib 72 and the stick 13 makes it possible for the piston 12 to repel or retract the stick 13, when the piston 12 is repelled or retracted. For clarity of illustration, the stick 13 is not shown within the generally cylindrical opening 24 in the piston 12, but the lip balm or other material constituting the stick 13 actually enters into the opening 24 when the tubular housing 10 is filled with the lip balm or other material. To facilitate the filling operation, the lip balm or other material is heated until it is in a molten or semimolten state so that the material will flow freely into the tubular housing 10 and also into the opening 24 in the piston 12. The lip balm or other material is then cooled so that it solidifies to form the stick 13.

Figure 19:
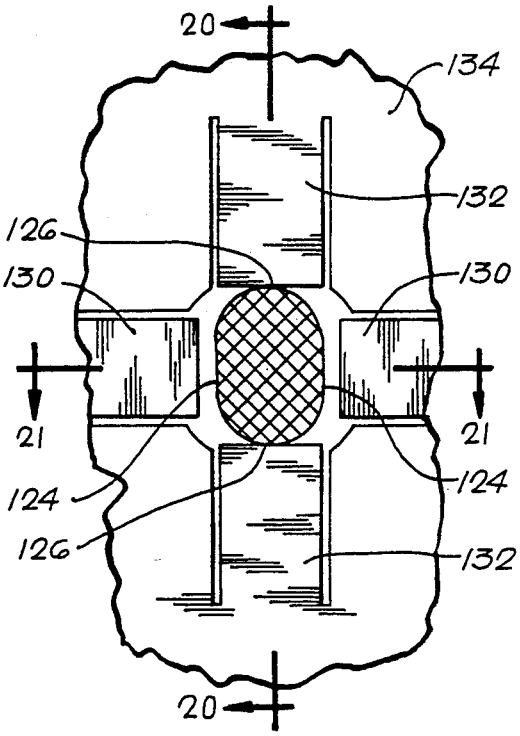
FIG. 19 is a cross-sectional view of a modified, second embodiment of the invention, involving a selectively reversible one-way translatory friction clutch.
Figure 20:
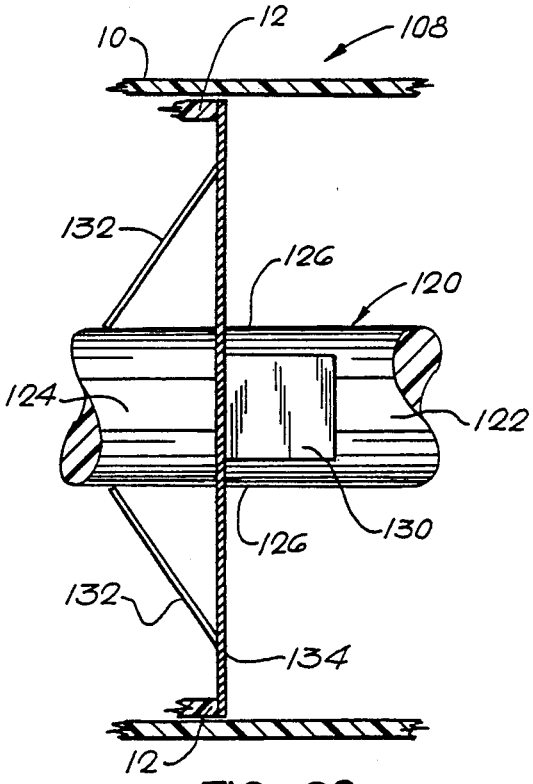
FIG. 20 is a fragmentary longitudinal section, taken generally along the line 20—20 in FIG. 19.
Figure 21:
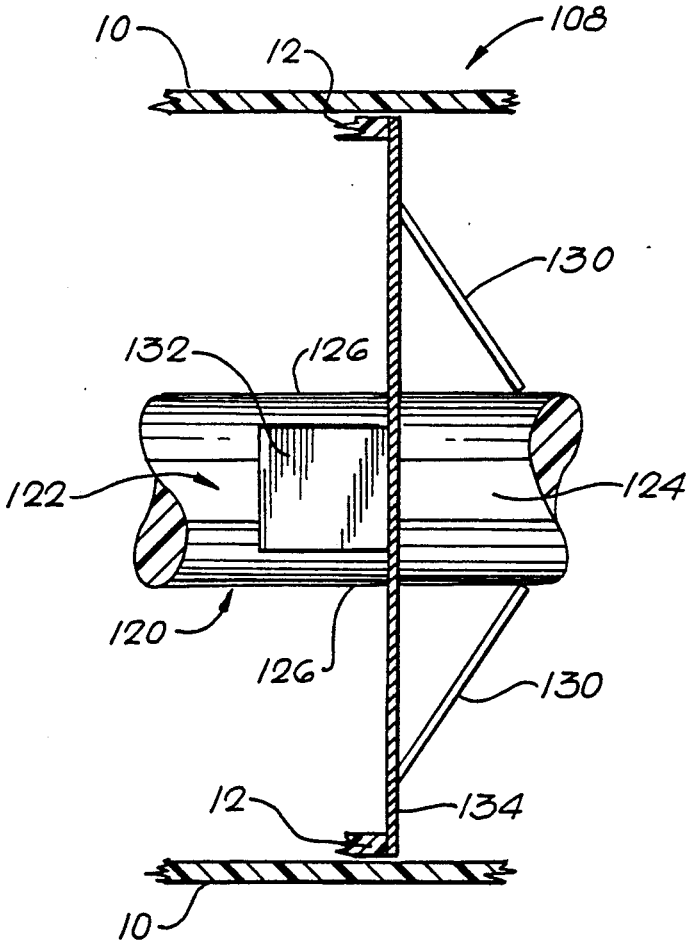
FIG. 21 is another fragmentary longitudinal section, taken generally along the line 21—21 in FIG. 19.

FIGS. 19–21 illustrate a second embodiment of the invention in the form of a modified package tube 108 having modified structural components which can be substituted for the post 20 and the pawls 30 and 32, previously described.

As shown in FIGS. 19–21, the tubular housing 10 may remain substantially the same as previously described. The post 20 is replaced with a modified post 120 which is oval in cross section but does not have the ratchet teeth 25 and the ratchet notches 26. Instead, the post 120 has a smooth outer surface 122 with a pair of relatively small diameter portions 124 and a pair of relatively large diameter clutch portions or members 126.

The propel pawls 30 are replaced by a pair of frictional propel pawls 130. Similarly, the repel pawls 32 are replaced by a pair of frictional repel pawls 132. As shown in FIGS. 19–21, the pawls 130 and 132 are in the form of flexible resilient blades cut and bent from a single piece or plate 134 of sheet metal which may be mounted on the piston 12 of FIG. 2.

As before, the modified package tube 108 can be switched between its propel mode and its repel mode by rotating or turning the post 120 through a predetermined angle, illustrated as approximately 90 degrees about its longitudinal axis.

As shown in FIGS. 19 and 20, the post 120 has been rotated to its repel mode position, in which the large diameter clutch portions 126 of the post 120 are in frictional engagement with the repel pawls 132. The small diameter portions 124 of the post 120 are opposite the propel pawls 130 but are spaced therefrom. When the post 120 is pushed upwardly or to the left as shown in FIG. 20, the large diameter clutch portions 126 of the post 120 slide idly past the repel pawls 132, because of the upward slant of the repel pawls. When the post 120 is returned downwardly or to the right, as shown in FIG. 20, the repel pawls 132 are moved to the right by the post 120, because the repel pawls 132 tightly grip the large diameter clutch portions 126 of the post and tend to dig in slightly, into the resilient surface of the post 120. Thus, the return or downward movement of the post 120 causes the plate 134 and the piston 12 to move in their repelling or retracting direction.

The post 120 may be turned through a predetermined angle, illustrated as substantially 90 degrees, so that the large diameter clutch portions 126 of the post engage the propel pawls 130, as shown in FIG. 21, while the small diameter portions 124 of the post 120 are spaced from the repel pawls 132. When the post 120 is pushed upwardly or to the left, as viewed in FIG. 20, the propel pawls 130 and the plate 134 are propelled upwardly with the post, because the propel pawls 130 tightly grip the large diameter clutch portions 126 of the post 120 and tend to dig in slightly into the resilient surfaces of the large diameter clutch portions 126, due to the downward slant of the propel pawls 130. When the post 120 is returned downwardly or to the right, the large diameter clutch portions 126 of the post 120 slide freely or idly past the propel pawls 130. The post 120 may be operated through successive cycles of upward and downward movement to propel the propel pawls 130, the plate 134 and the piston 12 upwardly, so as to advance the stick 13 of lip balm or the like, out of the first or upper end of the tubular housing 10. Except as described above in connection with FIGS. 19–21, the modified package tube 108 may be the same in construction as the previously described package tube 8 of FIGS. 1–18.

In another aspect, the structure or mechanism of FIGS. 19–21 comprises a selectively reversible one-way translatory clutch, connected between the post 120 and the piston 12, both of which are translatory members, whereby the post 120 may be employed for either propelling or repelling the piston 12. It will be understood that the post 120, like the post 20, is supported for axial translatory movement in the propel and repel directions by means including the tubular housing 10 and the generally cylindrical knob 14. The piston 12 constitutes a translatory member which is supported for axial translatory movement in the propel and repel directions by means including the tubular housing 10 and the generally cylindrical interior surface or opening 48 therein. The post 120 is supported for angular rotary adjusting movement through a limited predetermined angle about its axis between propel and repel positions. The predetermined angle is illustrated as approximately 90 degrees.

The post 120 has the diametrically opposite frictional clutch surfaces or members 126 of relatively great diameter, as well as the portions 124 of relatively small diameter, interspersed between the frictional clutch surfaces 126, and adapted to be spaced inwardly out of operative engagement with the propel and repel pawls 130 and 132. When the post 120 is rotated or turned to its propel position, the frictional clutch surfaces 126 are moved into engagement with the propel clutch members or pawls 130. When the post 120 is rotated to its repel position, the frictional clutch surfaces 126 are moved into engagement with the repel pawls or members 132.

When the knob 14 and the post 120 are rotated to their propel position, the user is able to propel or advance the translatory plate 134 and its supporting piston 12 by alternately pushing and releasing the knob 14. When the knob 14 and the post 120 are rotated to their repel position, the user is able to repel or retract the plate 134 and the piston 12 by alternately pushing and releasing the knob 14.

Various other modifications, alternative constructions and equivalents may be employed without departing from the true spirit and scope of the present invention, as exemplified in the preceding description, and as defined in the following claims.

I claim:

1. A package tube for receiving and dispensing a stick of lip balm or the like, said package tube comprising a tubular housing having first and second opposite ends, said first end having a first generally cylindrical opening therein for receiving the stick of lip balm or the like and for dispensing the stick out of the first end of said housing, a generally cylindrical piston slidably movable in the cylindrical opening and engageable with the stick for pushing the stick out of the opening, said second end of the tubular housing having a second generally cylindrical opening therein, a generally cylindrical operating knob rotatably and slidably received in the second cylindrical opening at the second end of the tubular housing, said knob having an axial post thereon extending axially into the tubular housing along a portion of said second cylindrical opening and a portion of said first cylindrical opening, said housing and said knob having first stop means for retaining said knob in said housing for limited axial sliding movement into and out of said second opening in said housing, said housing and said knob having second stop means for limiting the rotation of said knob to a turning movement of approximately 90 degrees between propel and repel positions, said piston having at least one propel pawl and at least one repel pawl thereon spaced apart by approximately 90 degrees, said post having at least one ratchet means thereon for selective presentation to said propel pawl when the knob is in its propel position and to the repel pawl when the knob is in its repel position, and spring means acting between said tubular housing and said knob for resiliently biasing said knob outwardly relative to the second opening in the housing, said knob when in its propel position being movable inwardly for propelling the piston and the stick and thereby dispensing the stick, said knob when in its repel position being movable inwardly against the biasing action of the spring means and being movable outwardly by the spring means for repelling the piston and the stick.

2. A package tube according to claim 1, in which said piston has a pair of diametrically opposite propel pawls and a pair of diametrically opposite repel pawls thereon, said propel pawls and said repel pawls being spaced apart by approximately 90 degrees, said post having a pair of diametrically opposite ratchet means thereon for selective presentation to said propel pawls when the knob is in its propel position and to the repel pawls when the knob is in its repel position.

3. A package tube according to claim 2, in which each of said propel pawls slants radially inwardly and toward the second end of the tubular housing, while each of said repel pawls slants radially inwardly and toward the first end of the tubular housing.

4. A package tube according to claim 2, in which said ratchet means comprise diametrically opposite sets of ratchet teeth on said post and alternating with ratchet notches therein, said post having a pair of substantially smooth portions disposed between said diametrically opposite sets of ratchet teeth.

5. A package tube according to claim 3, in which said piston and said pawls are formed in one piece from a resilient resinous plastic material, each of said pawls being blade-like in shape and having a portion of reduced thickness forming a flexible resilient hinge-like structure.

6. A package tube according to claim 4, including longitudinal rib and groove means disposed between said tubular housing and said piston for preventing rotation of said piston in said first cylindrical opening while providing for sliding movement of said piston along said first cylindrical opening.

7. A package tube according to claim 4, including sealing means between said piston and said post for preventing any substantial leakage of lip balm or other material therebetween, said sealing means comprising a bushing mounted in said piston and having an axial opening for slidably receiving said post.

8. A package tube according to claim 1, in which said first stop means comprise a transverse wall in said housing and having an axial opening for receiving said post, and a tapered flange projecting outwardly from said post for easy press fitting through said axial opening in said transverse wall.

9. A package tube according to claim 8, said spring means comprising a coil spring received around said post and compressed between said transverse wall and said knob.

10. A package tube for receiving and dispensing a stick of lip balm or the like, said package tube comprising a tubular housing having first and second opposite ends, said first end having a first generally cylindrical opening therein for receiving the stick of lip balm or the like and for dispensing the stick out of the first end of the housing, a generally cylindrical piston slidably movable in the cylindrical opening and engageable with the stick for pushing the stick out of the opening, said second end of the tubular housing having a second generally cylindrical opening therein, a generally cylindrical operating knob rotatably and translatably received in the second cylindrical opening at the second end of the tubular housing, said knob having an axial post thereon extending axially into the tubular housing along a portion of said second cylindrical opening and a portion of said first cylindrical opening, said housing and said knob having first stop means for retaining said knob in said housing for limited axial translatory movement into and out of said second opening in said housing, said housing and said knob having second stop means for limiting the rotation of said knob to a turning movement through a predetermined angle between propel and repel positions, said piston and said post having selectively operable one-way propelling clutch means operative when said knob is turned to its propel position for translating said piston toward said first end of said housing, said piston and said post having selectively operable one-way repelling clutch means operative when said knob is turned to its repel position for repelling said piston toward said second end of said housing, said propelling clutch means comprising a pair of diametrically opposite propel pawls on said piston, said repelling clutch means comprising a pair of diametrically opposite repel pawls on said piston, said propel pawls and said repel pawls being spaced apart on said piston by said predetermined angle, said post having diametrically opposite clutch members thereon for selective presentation to said propel pawls when the knob is in its propel position and to the repel pawls when the knob is in its repel position, and spring means acting between said tubular housing and said knob for resiliently biasing said knob outwardly relative to the second opening in the housing, said knob when in its propel position being movable inwardly for propelling the piston and the stick and thereby dispensing the stick, said knob when in its repel position being movable inwardly against the biasing action of the spring means and being movable outwardly by the spring means for repelling the piston and the stick.

11. A package tube according to claim 10, in which said propel and repel pawls are in the form of ratchet pawls, said clutch members on said post comprising diametrically opposite sets of ratchet teeth on said post and alternating with ratchet notches therein for selective angular adjusting movement between said propel pawls and said repel pawls when said knob is turned between the respective propel and repel positions thereof.

12. A package tube according to claim 10, in which said propel clutch pawls are in the form of a pair of diametrically opposite friction clutch pawls on the piston and slanting radially inwardly and toward the second end of the tubular housing, said repel clutch pawls being in the form of a pair of diametrically opposite friction clutch pawls on the piston and slanting radially inwardly and toward the first end of the tubular housing, said clutch members on said post being in the form of a pair of diametrically opposite friction clutch members projecting radially outwardly on the post to an enlarged diameter relative to the remainder of said post for angular movement between operative engagement with said propel pawls and said repel pawls when said knob is turned between its respective propel and repel positions.

13. A package tube according to claim 12, in which said propel and repel pawls are in the form of flexible resilient blade-like members having end edges for frictional engagement with the frictional clutch members on the post, said frictional clutch members having diametrically opposite smooth frictional surfaces of relatively great diameter, said post having portions of relatively smaller diameter interspersed between said clutch surfaces and adapted to be spaced radially inwardly out of engagement with the pawls.

14. A package tube according to claim 13, in which the flexible resilient blade-like members are made of sheet metal.

15. A package tube according to claim 13, in which all of said flexible resilient blade-like members are formed from a single piece of sheet metal mounted on said piston.

16. A selectively reversible one-way translatory clutch, comprising an elongated post having a longitudinal axis, means supporting said post for axial translatory movement in opposite propel and repel directions, said means also providing for angular rotary adjusting movement of said post through a limited predetermined angle about its axis between propel and repel positions, a translatory member having an axis aligned with the axis of the post, means for supporting said member for axial translatory movement in the propel and repel directions along the axis of said post, a pair of diametrically opposite propel pawls on said member, and a pair of diametrically opposite repel pawls on said member, said propel and repel pawls being spaced apart by said predetermined angle about the axis of said post, said propel pawls comprising a pair of diametrically opposite flexible resilient blade-like propel pawl members having end edges for frictional engagement with the post, said blade-like propel pawl members slanting radially inwardly and in the repel direction, said repel pawls comprising a pair of diametrically opposite flexible resilient blade-like repel pawl members having end edges for frictional engagement with the post, said repel pawl members slanting radially inwardly and in the propel direction, said post having diametrically opposite frictional clutch surfaces of relatively great diameter, said post having portions of relatively small diameter interspersed between said frictional clutch surfaces and adapted to be spaced radially inwardly out of operative engagement with the pawls, said frictional clutch surfaces being selectively movable into engagement with said propel clutch members when said post is rotated to its propel position while being selectively movable into frictional engagement with said repel pawl members when said post is rotated to its repel position.

17. A selectively reversible one-way translatory clutch according to claim 16, in which said blade-like propel clutch pawl members and said blade-like repel clutch pawl members are made of flexible resilient sheet metal.

18. A selectively reversible one-way translatory clutch according to claim 16, in which said blade-like propel clutch members and said blade-like repel clutch members are formed on a single piece of flexible resilient sheet metal, said clutch including means for preventing rotation of said single piece of sheet metal about the axis of said post.

* * * * *